US005971395A

United States Patent [19]

Swift

[11] Patent Number: 5,971,395

[45] Date of Patent: Oct. 26, 1999

[54] STRATEGY BOARD GAME METHOD AND APPARATUS

[76] Inventor: James B. Swift, 1330 Wincrest Ave., Eagan, Minn. 55123-1476

[21] Appl. No.: 09/058,655

[22] Filed: Apr. 10, 1998

[51] Int. Cl.[6] ..... A63F 3/00

[52] U.S. Cl. ..... 273/262; 273/242

[58] Field of Search ..... 273/262, 255, 273/258, 261, 260, 242

[56] References Cited

U.S. PATENT DOCUMENTS

| | | | |
|---|---|---|---|
| 1,294,256 | 2/1919 | George | 273/262 |
| 1,554,094 | 9/1925 | Huff et al. | 273/242 |
| 3,863,927 | 2/1975 | Moritz | 273/258 |
| 3,995,704 | 12/1976 | Blickman | 273/258 |
| 4,036,501 | 7/1977 | Hovnanian | 273/258 |
| 4,037,843 | 7/1977 | Hoffman | 273/261 |
| 4,256,309 | 3/1981 | McQuillan | 273/258 |
| 4,280,704 | 7/1981 | Massimei et al. | 273/258 |
| 4,613,134 | 9/1986 | Tobin | 273/242 |
| 4,634,129 | 1/1987 | Martinez | 273/255 |
| 4,991,855 | 2/1991 | Hazlewood | 273/258 |
| 5,064,201 | 11/1991 | Smith | 273/258 |
| 5,188,369 | 2/1993 | Loewenton | 273/258 |
| 5,306,016 | 4/1994 | McInnis | 273/258 |
| 5,318,305 | 6/1994 | LoCoco | 273/258 |
| 5,464,224 | 11/1995 | Rosenbaum | 273/258 |

OTHER PUBLICATIONS

U.S. Ser. No. 695,583, Stategio Instructions, Copyright 1986 by Milton Bradley Co., pp. 1–6.

*Primary Examiner*—Benjamin H. Layno

[57] ABSTRACT

A method and apparatus for playing a strategy board game that consists of a game board and a predetermined number of movable game pieces. The playing surface comprises a plurality of regions. Each region is defined laterally by the entire width of the playing surface and longitudinally by one of the adjacent regions and the end of the playing surface. One of the regions is a West region that has a first color and includes a first zone and a second zone. The first zone includes a pair of rows, each row includes a plurality of squares. The plurality of squares is defined by perpendicularly disposed longitudinal and transversal grid lines which extend in longitudinal East-West and transversal North-South directions. Each square has a foreground and a background. The foreground is within the grid lines of the square and has one of a third color and a fourth color. The background at least partially surrounds the grid lines of the square. The background color is determined by the color of the region which the square lies within. The background color is one of a first color and a second color. Each of the rows includes a plurality of squares that has a fourth color foreground and one wall disposed over the adjoining background of four squares within the same zone extending longitudinally two squares in length and disposed transversely one square away from another wall in an adjacent zone.

4 Claims, 4 Drawing Sheets

STRATEGY BOARD GAME METHOD AND APPARATUS

BACKGROUND OF THE INVENTION

This invention relates generally to a game method and apparatus, and more particularly, but not by way of limitation, to a game method and apparatus having a game board with a plurality of regions, zones, squares having foreground and background colors and having game pieces that change value at different locations.

An example of a game board using game pieces with various ranks that attack opponent game pieces with the outcome that the lower ranking game piece is captured and put out of play is disclosed in the game called Strategy, © 1986 by Milton Bradley Co. under Berne & Universal Copyright Conventions. U.S. Pat. No. 695,583. Each army consists of 1 Marshal rank 1, 1 General rank 2, 2 Colonels rank 3, 3 Majors rank 4, 4 Captains rank 5, 4 Lieutenants rank 6, 4 Sergeants rank 7, 5 Miners rank 8, 8 Scouts rank 9, and 1 Spy rank S that are moveable pieces and 6 bombs and 1 flag that are unmoveable pieces. The lower rank number indicates a higher game piece rank. The object of game is to be the first to capture the enemy flag.

Another example is disclosed in Smith U.S. Pat. No. 5,064,201. The game board apparatus consists of a game board having a playing surface and a predetermined number of movable game pieces. Boundary markings coincident with selected grid lines are used for dividing the playing surface into a plurality of subset areas of the playing surface. One of the subset areas is a perimeter subset area, a second subset area is an intermediate subset area and a third subset area is a center subset area. A movement value to each of the subset areas is assigned such that each subset area has a different movement value. Movable game pieces are initially positioned on designated starter squares located in the perimeter subset area. A player may move selected game pieces a selected distances along the game board in one of the first direction, the second direction and a diagonal direction, the selected distance traveled being determined by the value of the subset area in which the game piece is located prior to being moved in order to attain one of a first winning goal and a second winning goal. The first winning goal is the capture of a majority of an opponent's game pieces by moving a game piece by coterminous moves to land on a square occupied by an opponent's game piece which results in capture of the opponent's game piece. The second winning goal is to be the first to position game pieces in one of an aligned first direction row, an aligned second direction row and an aligned diagonal row in the third subset area by coterminous moves of one's game pieces.

Although, in general, these games have been satisfactory, those type of games have not been found to be entirely suitable in game applications where a major requirement is for a game piece having multiple values, that changes value as the game piece changes location on the board, and a game piece that is to the same degree more powerful in one zone as it is less powerful in another zone. The desired benefit is to make all of a player's pieces useful and actively played in contrast to games similar to Strategy, in which the lower rankling pieces with no special ability having a rank of 5, 6, & 7 and comprising 16 of the 40 pieces are of not, much use unless the higher rankling pieces are lost.

Nor have those type of games been found to be entirely suitable in game applications where a major requirement is for a game piece having a face designed for a player to easily decode a piece's multiple values and to evaluate it by making a direct visual assessment of the piece instead of making an intermediate numerical calculation.

A new and improved game board layout is desired that creates interesting scenarios by spreading out the play of the game both laterally and longitudinally in contrast to other games in which the action often consists of the two sides grinding away at each other along the middle axis of the board.

SHORT STATEMENT OF THE INVENTION

According to the present invention, the foregoing and other objects are attained by providing a method and apparatus for playing a game board apparatus. The game board apparatus consists of a game board with a playing surface and a predetermined number of movable game pieces. The playing surface comprises a plurality of regions.

Each region is defined laterally by the entire width of the playing surface and longitudinally by one of the adjacent regions and the end of the playing surface one of the regions is a West region. The West region has a first color and includes a first zone and a second zone. The first zone includes a pair of rows, each row includes a plurality of squares. The plurality of squares is defined by perpendicularly disposed longitudinal and transversal grid lines which extend in longitudinal East-West and transversal North-South directions. Each square has a foreground and a background. The foreground is within the grid lines of the square and has one of a third color and a fourth color. The background at least partially surrounds the grid lines of the square. The background color is determined by the color of the region which the square lies within. The background color is one of a first color and a second color. Each of the rows includes a plurality of squares that has a fourth color foreground and one wall disposed over the adjoining background of four squares within the same zone extending longitudinally two squares in length and disposed transversely one square away from another wall in an adjacent zone.

The second zone comprises a pair of rows that includes a plurality of squares which have a third color foreground, and two walls disposed over the adjoining background of four squares within the same zone extending longitudinally two squares in length and disposed transversely two squares away from another wall in the same zone and disposed transversely one square away from another wall in an adjacent zone.

Another region is a Middle region. The Middle region has a second color and includes a third zone, a fourth zone, a fifth zone and a sixth zone. The third zone comprises a pair of rows that includes a plurality of squares which have a third color foreground, and three walls. The walls are disposed over the adjoining background of four squares within the same zone extending longitudinally two squares in length and disposed transversely two squares away from another wall in the same zone and disposed transversely one square away from another wall in an adjacent zone.

The fourth zone comprises a pair of rows that includes a plurality of squares which have a fourth color foreground, and three walls disposed over the adjoining background of four squares within the same zone extending longitudinally two squares in length and disposed transversely two squares away from another wall in the same zone and disposed transversely one square away from another wall in an adjacent zone.

The fifth zone comprises a pair of rows that includes a plurality of squares which have a third color foreground, and three walls disposed over the adjoining background of four squares within the same zone extending longitudinally two squares in length and disposed transversely two squares away from another wall in the same zone and disposed transversely one square away from another wall in an adjacent zone.

The sixth zone comprises a pair of rows that includes a plurality of squares which have a fourth color foreground, and three walls disposed over the adjoining background of four squares within the same zone extending longitudinally two squares in length and disposed transversely two squares away from another wall in the same zone and disposed transversely one square away from another wall in an adjacent zone.

Still another region is an East region. The East region has a first color and comprises a seventh zone and an eighth zone. The seventh zone comprises a pair of rows that includes a plurality of squares which have a fourth color foreground and two walls. The walls are disposed over the adjoining background of four squares within the same zone extending longitudinally two squares in length and disposed transversely two squares away from another wall in the same zone and disposed transversely one square away from another wall in an adjacent zone.

The eighth zone comprises a pair of rows that includes a plurality of squares which have a third color foreground, and one wall disposed over the adjoining background of four squares within the same zone extending longitudinally two squares in length and disposed transversely one square away from another wall in an adjacent zone.

One step in the method is assigning a value to each of the game pieces such that each game piece may have a different value on a different colored foreground and background of the landing square for the game piece move.

Another step in the method is initially positioning movable game pieces belonging to the first player on any of the squares of the three most Westerly rows and the second player on any of the squares of three most Easterly rows.

Still another step in the method is moving selected game pieces, within a player's turn, relative from the game piece move starting position, selected distances along the game board in one of the longitudinal direction, the transversal direction, and both the longitudinal direction and the transversal direction but never in a backwards direction. The maximum selected distance traveled forward per turn is any square in the adjacent zone relative to the game piece move starting position. The maximum selected distance traveled transversely per turn is limited by one of the portions of each region without squares, and by a wall. Finally, in order to win the game, the victory condition is the first game piece to move off the opponent's end of the game board.

The present invention provides a method and apparatus with a game piece having multiple values that changes value as the game piece changes location on the board. Moreover, the degree to which a game piece is more powerful in one zone is the same degree to which the game piece is less powerful in another zone. The resulting benefit is that any game piece can capture any opposing game piece; the outcome simply depends on where the confrontation occurs. Therefore, all of a player's pieces are useful and may be actively engaged in play.

The present invention also provides a method and apparatus with a game piece having a face of the game piece designed to make it easy for the player to decode the piece's multiple values. For example, a green-7 is valued at 7 on a green square and 2 on a white square. This information could be encoded as "G7W2". However, the use of a white pair of vertical bars on a green field allows the player to make a direct visual assessment of the piece instead of making an intermediate numerical calculation. The player sees mostly green, and can think "pretty powerful on green"; the player sees a little white, and can think "not so powerful on white".

The use of "zones" comprising a pair of rows on the board allows for an interesting tactic. Two game pieces of lesser value may be used to confront a more powerful game piece. One game piece is sacrificed by moving it into the near row of the zone, which draws the powerful piece forward to capture it. The second piece then moves safely past the powerful piece that can not move backwards to the second row of the zone.

The layout of the board, with its overlapping color zones and placement of walls creates interesting scenarios by spreading out the play of the game both laterally and longitudinally. This is in contrast to other games in which the action often consists of the two sides grinding away at each other along the middle axis of the board.

This invention provides a method and apparatus for a fast playing pace permitting multiple square movement and that prevents indefinite stalling. The board game is easily learned yet challenging to play.

BRIEF DESCRIPTION OF THE DRAWINGS

Other objects and many of the attendant advantages of this invention will be readily appreciated as the same becomes better understood by reference to the following detailed description and when considered in connection with the accompanying drawings in which like reference numerals designate like parts throughout the figures and embodiments thereof.

1. DETAILED DESCRIPTION OF A PREFERRED EMBODIMENT

A preferred embodiment of the new and improved method and apparatus for playing a board game embodying the principles and concepts of the present invention will be described now more specifically and be illustrated by way of example in FIGS. 1–3.

1.1 Overview

Figure 1A:
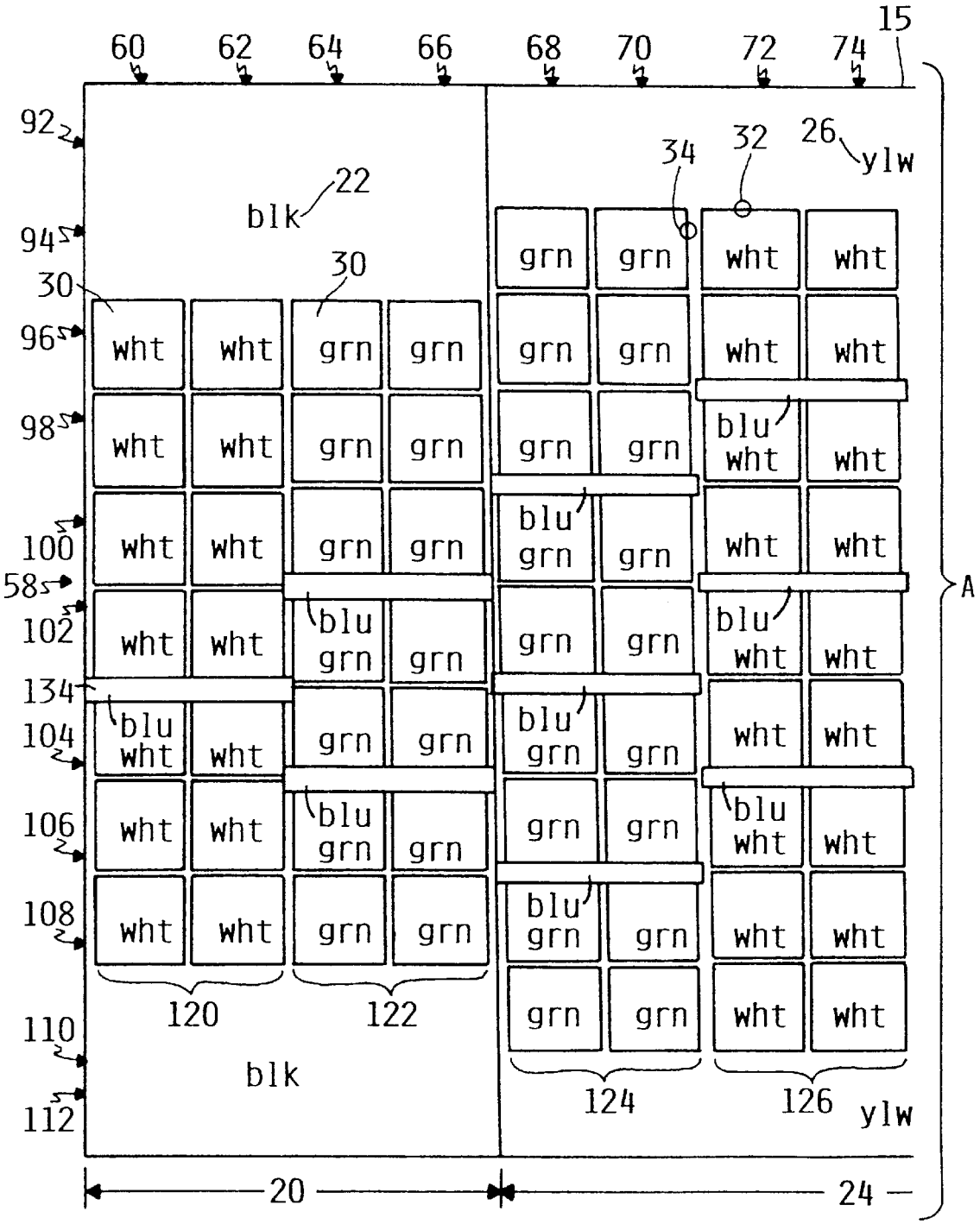
FIG. 1 shows a top plan view of a preferred embodiment of method and apparatus for playing a strategic board game of the present invention with some elements omitted.
Figure 1B:
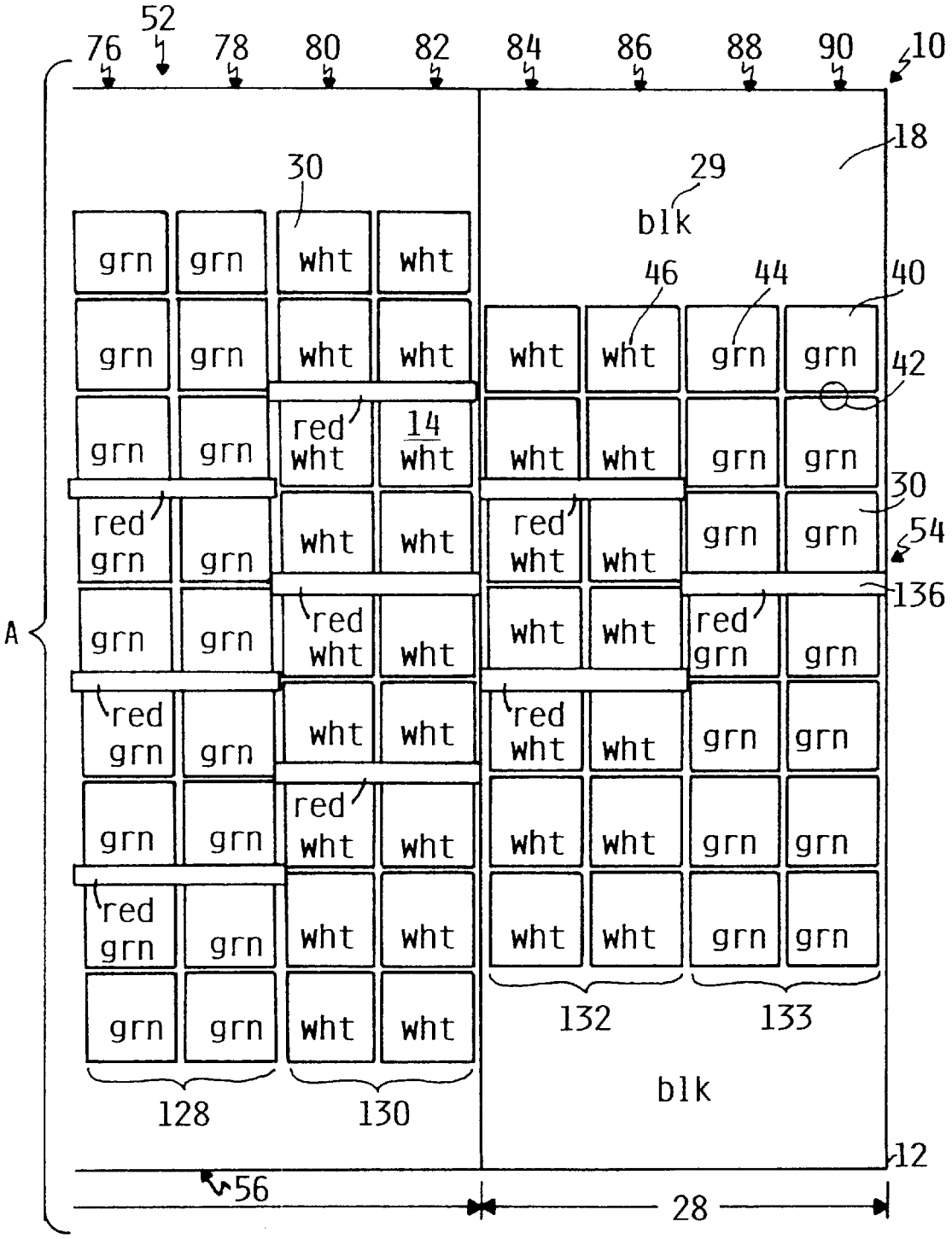

With specific reference to the first preferred embodiment of the invention illustrated in FIG. 1, the present invention provides a method and apparatus for playing a game board apparatus 10. The game board apparatus 10 consists of a game board 12 that has a playing surface 14 and as shown in FIG. 2, a predetermined number of movable game pieces 16. The playing surface 14 comprises a plurality of regions 18.

1.2 West Region 20

Each region 18 is defined laterally by the entire width of the playing surface 14 and longitudinally by one of the adjacent regions 18 and the end of the playing surface 14. The West region 20 has a first color 22 and includes a first zone 120 and a second zone 122. The first zone 120 includes a pair of rows 60,62, and each row 60,62 includes a plurality of squares 30. The plurality of squares 30 is defined by perpendicularly disposed longitudinal 32 and transversal 34 grid lines 32,34 which extend in longitudinal East 54-West 58 and transversal North 52-South 56 directions.

Each square 30 has a foreground 40 and a background 42. The foreground 40 is within the grid lines 32,34 of the square 30 and has one of a third color and a fourth color. The background 42 is at least partially surrounding the grid lines 32,34 of the square 30. The color of the background 42 is determined by the color of the region the square 30 lies within. The color of the background 42 is one of a first color and a second color. Each of the rows 60,62 includes a plurality of squares 30 that has a fourth color foreground 40, and one wall 134. The wall 134 is disposed over the adjoining background 42 of four squares 30 within the same zone extending longitudinally two squares 30 in length and disposed transversely one square 30 away from another wall 136 in an adjacent zone.

The second zone 122 comprises a pair of rows 64,66 and includes a plurality of squares 30 that have a third color foreground 40 and two walls 136 which are disposed over the adjoining background 42 of four squares within the same zone extending longitudinally two squares in length and are disposed transversely two squares away from another wall 134 in the same zone and disposed transversely one square away from another wall 134 in an adjacent zone.

1.3 Middle region 24

The Middle region 24 has a second color 26 and includes a third zone 124, a fourth zone 126, a fifth zone 128 and a sixth zone 130. The third zone 124 comprises a pair of rows 68,70 and includes a plurality of squares 30 that have a third color foreground 40, and three walls 134 disposed over the adjoining background 42 of four squares within the same zone extending longitudinally two squares in length and disposed transversely two squares away from another wall 134 in the same zone and disposed transversely one square away from another wall 134 in an adjacent zone.

The fourth zone 126 comprises a pair of rows 72,74 and includes a plurality of squares 30 that have a fourth color foreground 40, and three walls 134 disposed over the adjoining background 42 of four squares within the same zone extending longitudinally two squares in length and disposed transversely two squares away from another wall 134 in the same zone and disposed transversely one square away from another wall 134 in an adjacent zone.

The fifth zone 128 comprises a pair of rows 76,78 and includes a plurality of squares 30 that have a third color foreground 40, and three walls 136 disposed over the adjoining background 42 of four squares within the same zone extending longitudinally two squares in length and disposed transversely two squares away from another wall 136 in the same zone and disposed transversely one square away from another wall 136 in an adjacent zone.

The sixth zone 130 comprises a pair of rows 80,82 and includes a plurality of squares 30 that have a fourth color foreground 40, and three walls 136 disposed over the adjoining background 42 of four squares within the same zone extending longitudinally two squares in length and disposed transversely two squares away from another wall 136 in the same zone and disposed transversely one square away from another wall 136 in an adjacent zone.

1.4 East region 28

Still another region is an East region 28 that also has another first color 29. The East region 28 comprises a seventh zone 132 and an eighth zone 133. The seventh zone 132 comprises a pair of rows 84,86 that includes a plurality of squares 30 that have a fourth color 46 foreground 40, and two walls 136. The two walls 136 are disposed over the adjoining background 42 of four squares 30 within the same seventh zone 132 extending longitudinally two squares in length and disposed transversely two squares away from another wall 136 in the same seventh zone 132 and disposed transversely one square away from another wall 136 in adjacent sixth zone 130 and adjacent eighth zone 133.

The eighth zone 133 comprises a pair of rows 88,90 and includes a plurality of squares 30 that have a third color 44 foreground 40, and one wall 136 disposed over the adjoining background 42 of four squares 30 within the same zone 133 extending longitudinally two squares in length and disposed transversely one square away from another wall 136 in an adjacent seventh zone 132.

1.5 Object

The strategic board game method and apparatus is made for two players. To win the game, the player with the first game piece 16 to move off the opponent's end of the game board 12 wins.

1.6 Setup

In a preferred embodiment of the invention, playing equipment includes the game board 12, twenty-one red game pieces 16, and twenty-one blue garme pieces 16. To setup the game, the game board 12 is positioned between the two players such that the short ends of the board at the West direction 58 and the East direction 54 face the players. One player plays the red game pieces 16, and the other player uses the blue game pieces 16.

At the start of the game, in the preferred embodiment, each player initially positions twenty-one movable game pieces 16 of one color belonging to the first player on the squares 30 of the three most Westerly 58 rows 60, 62 64 with one game piece 16 in each such square 30 and twenty-one movable game pieces 16 of another color belonging to the second player on the squares of three most Easterly 54 rows 86,88,90.

Figure 2:
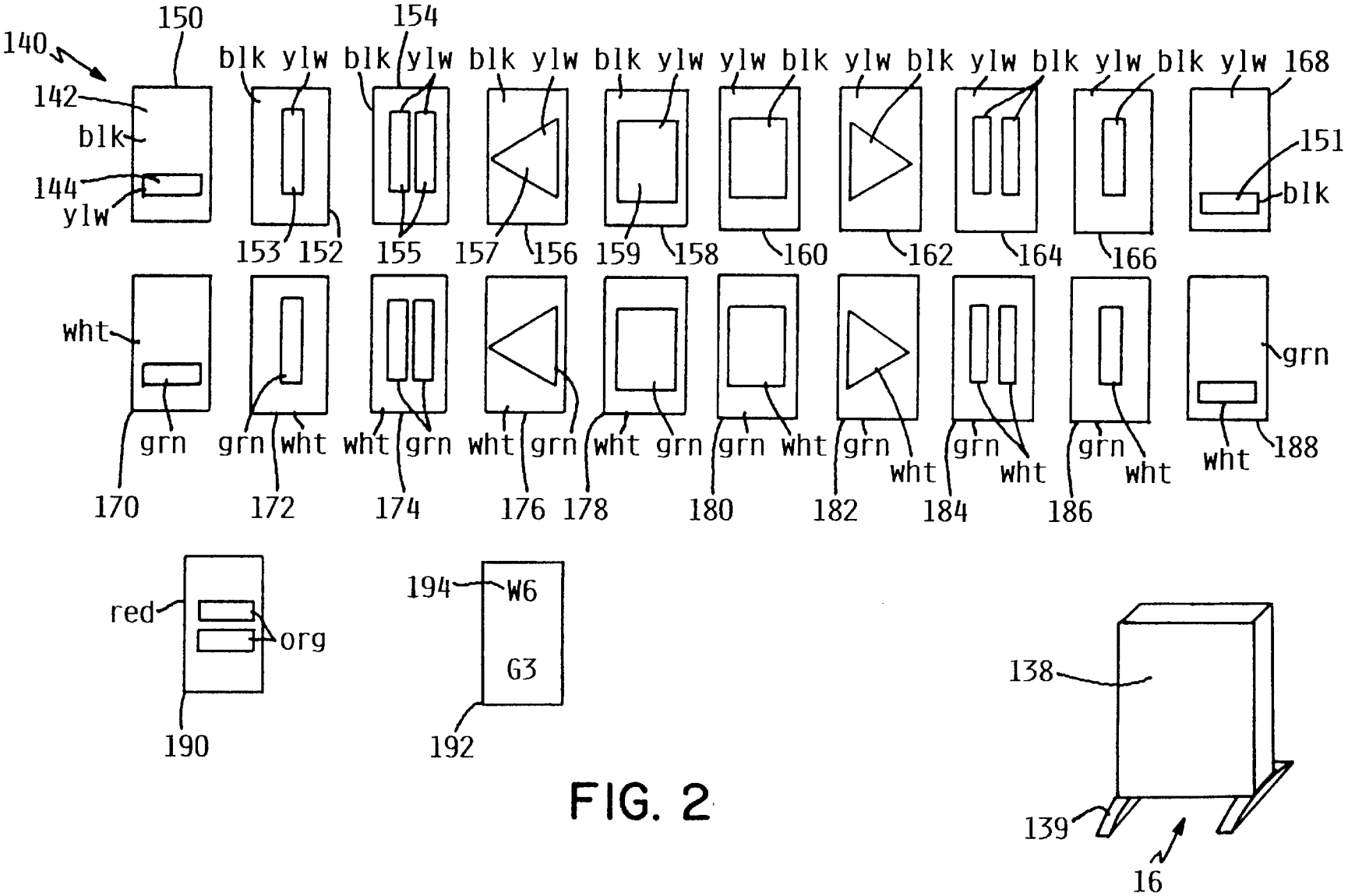
FIG. 2 as viewed by the player that orals the game piece is a front side elevational view of a preferred embodiment of the visual code, field and symbol and an Indicium with an alphanumeric

Each of the game pieces 16 has a face 138 as shown in FIG. 2. The face 138 has a code 140 disposed upon the face 138. The code 140 comprises a field 142 and a symbol 144. The field 142 has one of a third color, fourth color, second color and first color. The symbol 144 is one of underbar 151, vertical bar 153, double vertical bar 155, triangle 157, and square 159 and has one of a third color, fourth color, second color and first color. In one preferred embodiment of the invention, the first color 22 is black, the second color 26 is yellow, the third color 44 is green and the fourth color 46 is white.

The code 140 on the face 138 of each game piece 16 of the player must be placed for viewing by the player and hidden from the view of the player's opponent. The game pieces 16 may be arranged in any pattern. Thus, each player begins play with a game piece 16 having a code 140 of the black field yellow underbar 150, the black field yellow vertical bar 152, the black field yellow double vertical bar 154, the black field yellow triangle 156, the black field yellow square 158, the yellow field black underbar 168, the yellow field black vertical bar 166, the yellow field black double vertical bar 164, the yellow field black triangle 162, the yellow field black square 160, the white field green underbar 170, the white field green vertical bar 172, the white field green double vertical bar 174, the white field green triangle 176, the white field green square 178, the green field white underbar 188, the green field white vertical bar 186, the green field white double vertical bar 184, the green field white triangle 182, the green field white square 180, and finally the red field orange equal sign 190, also called the punch.

1.7 Board Landmarks

The game board 12 is divided in half by a center line 15 that runs transversely across the entire game board 12. The playing area consists of sixteen rows of 7 or 9 squares 30 between the two ends of the board. The rows run transversely across the game board 12 in the North direction 52 and the South direction 56. Rows 60,62,64,66 are in the West region 20. Rows 68,70,72,74,76,78,80,82 are in the Middle region 24 the East region has the remaining rows 84,86,88,90. Each pair of rows comprises one zone. There are eight zones. Zones 120 and 122 are in the West region 20. The Middle region 24 includes zones 124, 126,128, and 130. The East region has zones 132 and 133.

The game board 12 also has eleven columns. The columns run longitudinally across the game board 12 in the West direction 58 and the East direction 54. Columns 92 and 112 on the game board 12 have no squares 30 and are off limits to the game piece 16. Columns 94 and 110 in the West region 20 and the East region also lack squares 30 and are off limits. The remaining columns 96,98,100,102,104,106,108 do have squares 30 throughout all three regions 20,24,28 and are within the playing limits of the game board 12 to the game piece 16.

Each square 30 has both a foreground 40 color and a background 42 color. The foreground 40 color is the inside color of the square 30 and in a preferred embodiment of the invention is either the third color 44, green or the fourth color 46, white. The background 42 color is the color of the border adjacent to the square, as best seen in FIG. 1, first column 92 as borders 22, 26, 29 in regions 20,24,28 respectively and in a preferred embodiment is either the first color 22, black or the second color 26, yellow.

Each wall has a color and a rectangular dividing strip shape running longitudinally in the West direction 58 and the East direction 54 for a distance of two squares 30 in length between some of the squares 30 the blue wall 134 is found in each zone of the West direction 58 half of the game board 12 the red wall 136 is located in each zone of the East direction 54 half of the game board 12.

1.8 Movement Rules

Rules governing movement are as follows.

1. Players alternate turns. On each turn a player must move a single game piece 16. If a player has no remaining game piece 16, the player forfeits.

2. The game piece 16 may be moved any number and combination of squares sideways and/or forward but are subject to the limitations noted below. The game piece 16 may not move backward.

3. The game piece 16 may move within the same zone, or into the next zone, but may not move past the next zone. If the game piece 16 begins its move in the farthest zone on the board from the player's original staring position, the game piece 16 may and should move off the opponent's end of the board to claim the victory.

4. The game piece 16 may not move through a wall 134,136 nor off the side of the playing area without squares 30 on the North direction 52 and the South direction 56 of the game board 12.

For example, from a move starting position in the West region 20 at the first row 60 and the fifth column 100, a game piece 16 may move to the two squares 30 in the third row 64 and the fourth row 66 that lies in the seventh column 104 in addition to any the square 30 in the first zone 120 and the second zone 122 that lies North of the blue wall 134 in the first zone 120. In other words, the game piece 16 may move to the two squares specified in the seventh column 104 and to any square 30 in the West region 20 that lies in columns 96,98,100,102. Another example is, from a move starting position in the West region 20 at the fourth row 66 and the eighth column 106, a game piece 16 may move to any square 30 in the third zone 124 that lies South of the middle blue wall 134 in the third zone 124. That game piece 16 could also move to only one square 30 in the second zone 122 at the fourth row 66 and the ninth column 108.

5. The game piece 16 may jump over any friendly or opposing game piece 16.

6. The game piece 16 may not land in a square 30 already occupied by a friendly game piece 16.

7. The game piece 16 may land in a square 30 occupied by an opposing game piece 16. This constitutes an attack, which is resolved according to the attack resolution rules.

8. If the game piece 16 does not make an attack, then the game piece 16 must move at least one square forward.

Thus, one selected game piece 16, within a player's turn, must be moved relative from the game piece 16 move starting position a selected distance along the game board 12 in one of the longitudinal direction, the transversal direction, and both the longitudinal direction and the transversal direction but never in a backwards direction. The maximum selected distance traveled forward per player turn is any square 30 in the adjacent zone relative to the game piece 16 move starting position. The maximum selected distance traveled transversely per turn is limited by one of the portions of the regions 20,24,28 without squares 30 and any wall 134,136.

1.9 Game Piece 16 Values

A value is assigned to each of the game pieces 16 such that each game piece 16 may have a different value on a different colored foreground 40 and background 42 of the landing square 30 for the game piece 16 move. A game piece 16 value is determined by the colors of the field 142, the corresponding numeric of the symbol 144 of the code 140 on the face 138 of the game piece 16, the color of the symbol 144 of the code 140, and the foreground 40 and the background 42 colors of the square 30 on which the game piece 16 is placed. For an attacking game piece 16, the pertinent square 30 is the square 30 to which it is moving to, not the square 30 from which it is moving from.

The symbol 144 on the face 138 of a game piece 16 represents a number, as follows:

| Symbol | Number |
|---|---|
| underbar | 0 |
| vertical bar | 1 |
| two vertical bars | 2 |
| triangle | 3 |
| square | 4 |

When a game piece 16 is placed on square 30 with the same foreground 40 or background 42 color as the color of the symbol 144, the game piece 16 is worth the corresponding number. When the game piece 16 is elsewhere on the board, the game piece 16 is worth nine minus the corresponding number. For example see FIG. 2, specific code 182, the game piece 16 with a white triangle 157 on a green field 142 is worth 3 on white squares 30 and 6 on green squares 30 and is a called a "green-6". Another example is the specific code 150 on the game piece 16 with a yellow underbar 151 on a black field 142 is worth 0 on yellow squares 30 and 9 on black squares 30 and is called a "black-9". In addition, a game piece 16 with a specific code 190 has an orange equal sign on a red field and is a "punch". The punch 190 value is equal to the value of any opposing game piece 16 with which the punch 190 comes into contact.

1.10 Attack Resolution

The attacking player reveals the identity of the attacking game piece 16. The defending player then has the option of conceding and removing the defending game piece 16 without revealing its identity. Otherwise, the defending player reveals the identity of the defending game piece 16. The game piece 16 with the lower number value loses and is removed from play. The other game piece 16 remains in the contested square. If there is a tie, both game pieces 16 are removed.

Examples:

A green-8, the green field white vertical bar 186, attacks a green-5, the green field white square 180, on a green square 30. The attacking green-8, the green field white vertical bar 186, is revealed to the opponent to be worth 8. The defending green-5 is worth 5 and is removed without its identity being revealed. The green-8, the green field white vertical bar 186, claims the square 30.

A white-7, the white field green double vertical bar 174, attacks a yellow-6, the yellow field black triangle 162, on a green foreground 40, yellow background 42 square 30. The attacking white-7 is revealed to be worth 2. The defending yellow-6 is worth 6, is revealed and claims the square 30. The white-7 is removed.

A punch, the red field orange equal sign 190, attacks a black-9, the black field yellow underbar 150, on any square 30. The attacking punch 190 is revealed. The defending black-9 is revealed. Since they both are of equal value, both game pieces 16 are removed. Note that when a punch 190 attacks, the outcome is a foregone conclusion, however, the defending game piece 16 must still be revealed if it is to contest the attack and force a tie.

1.11 Tactics

The following strategies will help illustrate a preferred embodiment of the invention of the strategic board game method and apparatus. Turn to FIG. 3 for the following three tactics. A player is seated at the East direction 54 of the game board 12 who has game pieces represented by a square. An opponent is seated at the West direction 58 of the game board 12 who has game pieces represented by a circle. The dashed lines represent the direction and distance of movement. The arrow head represents the termination of the movement for one turn.

1.11.1 "The Sacrifice"

Looking now in the West region 20, "The Sacrifice" tactic is illustrated. Two weak player game pieces 200 and 210 confront a strong opposing game piece 310.

1) Player piece 200 first moves forward to square 201.

2) Opponent piece 310 is forced to move to square 201 to capture piece 200. If Opponent piece 310 chose not to move to square 201 to capture piece 200, piece 200 would advance to win on the next move.

3) Player piece 210 then moves to square 211 and advances past opponent piece 310. Note that opponent piece 310 cannot move backwards. Also note that opponent piece 300 is shielded by a blue wall 134 and can not help.

4) Finally, player piece 210 advances from square 211 to off the game board 12 to win.

1.11.2 "Basic Two-Piece Defense"

Directing your attention now to the Middle region 24, the "Basic Two-Piece Defense" tactic is shown. Opponent pieces 320 and 330 are positioned such that either piece can advance and attack any player piece which moves to any place inside the fourth zone 126 in addition to eight squares 30 in the third zone 124.

1.11.3 "The Has-Been Piece"

"The Has-Been Piece" tactic in shown in zones 133,132, 130. Opponent piece 340 has been revealed in a prior conflict to be a yellow-9, the yellow field black underbar 168. Opponent piece 340 is now positioned on the Eastern-most row of squares 30 having a yellow background color 42, specifically the 12th row 82; which means that if opponent piece 340 moves forward in an East direction 54, the opponent piece 340 would be worth a zero value. Therefore, 1) player piece 240 first moves past the opponent piece 340 to square 241 with impunity.

2) Opponent piece 340 cannot move backwards so the opponent must make some other move.

3) Player piece 240 then moves on to square 242.

1.11.4 "The Steel Curtain"

Figure 3:
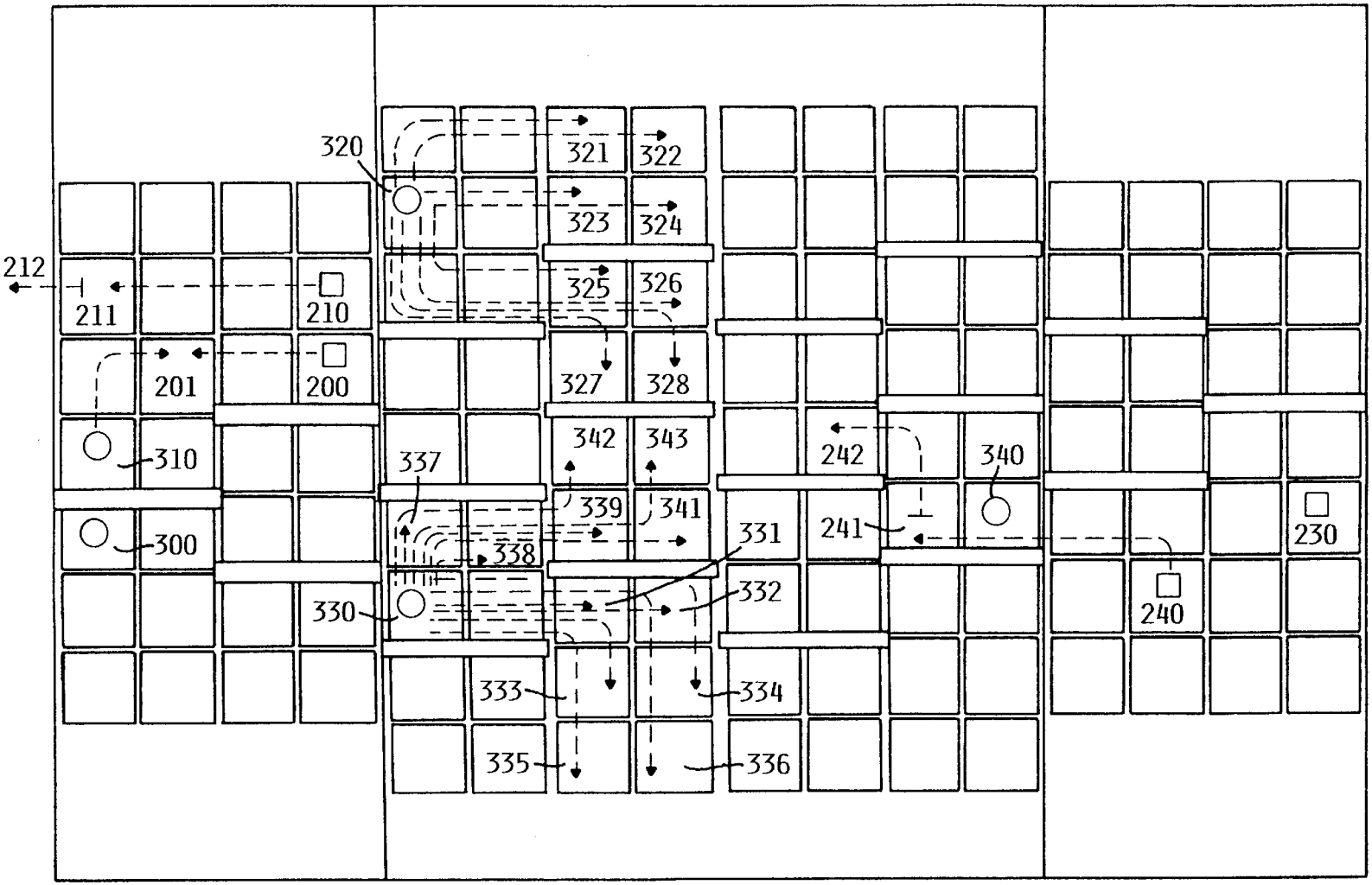
FIG. 3 shows a top plan view of three tactics that illustrate the preferred embodiment.

The remaining tactic is not shown in FIG. 3 but does rely on FIG. 1 references for board location description. This "The Steel Curtain" tactic occurs in the West region 20. Opponent A piece is located at first row 60 and third column 96. Opponent B piece is located at 2nd row 62 and 6th column 102. Player X piece is located at 4th row 66 and 4th column 98. Player Y piece is located at 4th row 66 and 5th column 100. Powerful opponent pieces A and B guard the North 52 side of their zone, specifically first zone 120.

1) Player piece X advances two squares forward in the West direction 58 to the square 30 at 2nd row 62 and 4th column 98.

2) Opponent B piece located at 2nd row 60 and 6th column 102 moves two squares in the North direction 52 to attack and to capture X on the square 30 at 2nd row 62 and 4th column 98. Note that because B attacked another's game piece 16, B does not have to make a forward move.

3) Fearing a similar fate, Y stays put, awaiting other developments.

1.12 Advantages The described versions of the present invention have many advantages including the benefit of at a fast playing pace permitting multiple square movement and that prevents indefinite stalling. The present invention addresses the need for a method and apparatus that provides a game outcome that is determined by skill and strategy rather that by chance. Specifically, an advantage of the present invention is the ability to The board game 10 is easily learned yet challenging to play.

1.13 Alternative Embodiments

An alternative embodiment to the preferred visually orientated code 140 of field 142 and symbol 144 arrangement shown in FIG. 2 is the indicium 192 of alphanumeric 194 arrangement also shown in FIG. 2. W6 G3 means white six green three game piece value.

While the preferred embodiment of the present invention has been disclosed above it should be appreciated that there are other embodiments within the invention. Obviously many modifications and variations of the present invention are possible in the light of the above teachings. It is therefore to be understood that, within the scope of the appended claims, the invention may be practiced otherwise than as specifically described.

I claim:

1. A game board apparatus comprising:

a game board having a playing surface and a predetermined number of movable game pieces, said playing surface comprising a plurality of regions, each region defined laterally by the entire width of the playing surface and longitudinally by one of the adjacent regions and the end of the playing surface;

one of the regions being a West region, the West region having a first color, the West region including a first zone and a second zone, the first zone including a pair of rows each row including a plurality of squares, the plurality of squares being defined by perpendicularly disposed longitudinal and transversal grid lines which extend in longitudinal East-West and transversal North-South directions,each square having a foreground and a background, the foreground being within the grid lines of the square and having one of a third color and a fourth color, the background being at least partially surrounding the grid lines of the square, the background color being determined by the color of the region the square lies within, the background color being one of a first color and a second color, each of the rows including a plurality of squares having a fourth color foreground, and one wall disposed over the adjoining background of four squares within the same zone extending longitudinally two squares in length and disposed transversely one square away from another wall in an adjacent zone;

the second zone comprising a pair of rows including a plurality of squares having a third color foreground, and two walls 136 disposed over the adjoining background of four squares within the same zone extending longitudinally two squares in length and disposed transversely two squares away from another wall in the same zone and disposed transversely one square away from another wall in an adjacent zone;

another region being a Middle region, the Middle region having a second color, the Middle region including a third zone, a fourth zone, a fifth zone and a sixth zone, the third zone comprising a pair of rows including a plurality of squares having a third color foreground, and three walls disposed over the adjoining background of four squares within the same zone extending longitudinally two squares in length and disposed transversely two squares away from another wall in the same zone and disposed transversely one square away from another wall in an adjacent zone;

the fourth zone comprising a pair of rows including a plurality of squares having a fourth color foreground, and three walls disposed over the adjoining background of four squares within the same zone extending longitudinally two squares in length and disposed transversely two squares away from another wall in the same zone and disposed transversely one square away from another wall in an adjacent zone;

the fifth zone comprising a pair of rows including a plurality of squares having a third color foreground, and three walls disposed over the adjoining background of four squares within the same zone extending longitudinally two squares in length and disposed transversely two squares away from another wall in the same zone and disposed transversely one square away from another wall in an adjacent zone;

the sixth zone comprising a pair of rows including a plurality of squares having a fourth color foreground, and three walls disposed over the adjoining background of four squares within the same zone extending longitudinally two squares in length and disposed transversely two squares away from another wall in the same zone and disposed transversely one square away from another wall in an adjacent zone;

still another region being an East region, the East region having a first color, the East region comprising a seventh zone and an eighth zone, the seventh zone comprising a pair of rows including a plurality of squares having a fourth color foreground, and two walls disposed over the adjoining background of four squares within the same zone extending longitudinally two squares in length and disposed transversely two squares away from another wall in the same zone and disposed transversely one square away from another wall in an adjacent zone;

the eighth zone comprising a pair of rows including a plurality of squares having a third color foreground, and one wall disposed over the adjoining background of four squares within the same zone extending longitudinally two squares in length and disposed transversely one square away from another wall in an adjacent zone;

each of the game pieces being assigned a value such that each game piece may have a different value on a different colored foreground and background of the landing square for the game piece move;

the game pieces being initially positioned such that game pieces belonging to the first player is placed on any of the squares of the three most Westerly rows and game pieces belonging to the second player is placed on any of the squares of three most Easterly rows.

2. The apparatus of claim 1 wherein each of the game pieces has a face, the face has a code disposed upon the face, the code comprises a field and a symbol, the field has one of a third color, fourth color, second color and first color;

the symbol being one of underbar, vertical bar, double vertical bar, triangle, and square and having one of a third color, fourth color, second color and first color.

3. A method for playing a game board apparatus wherein the game board apparatus consists of a game board having a playing surface and a predetermined number of movable game pieces, said playing surface comprising a plurality of regions;

each region defined laterally by the entire width of the playing surface and longitudinally by one of the adjacent regions and the end of the playing surface, one of the regions being a West region, the West region having a first color, the West region including a first zone and a second zone, the first zone including a pair of rows each row, including a plurality of squares, the plurality of squares being defined by perpendicularly disposed longitudinal and transversal grid lines, which extend in longitudinal East-West and transversal North-South directions, each square having a foreground and a background, the foreground being within the grid lines of the square and having one of a third color and a fourth color, the background being at least partially surrounding the grid lines of the square, the background color being determined by the color of the region the square lies within, the background color being one of a first color and a second color, each of the rows including a plurality of squares having a fourth color foreground, and one wall disposed over the adjoining background of four squares within the same zone extending longitudinally two squares in length and disposed transversely one square away from another wall in an adjacent zone;

the second zone comprising a pair of rows including a plurality of squares having a third color foreground, and two walls disposed over the adjoining background of four squares within the same zone extending longitudinally two squares in length and disposed transversely two squares away from another wall in the same zone and disposed transversely one square away from another wall in an adjacent zone;

another region being a Middle region, the Middle region having a second color, the Middle region including a third zone, a fourth zone, a fifth zone and a sixth zone, the third zone comprising a pair of rows including a plurality of squares having a third color foreground, and three walls disposed over the adjoining background of four squares within the same zone extending longitudinally two squares in length and disposed transversely two squares away from another wall in the same zone and disposed transversely one square away from another wall in an adjacent zone;

the fourth zone comprising a pair of rows including a plurality of squares having a fourth color foreground, and three walls disposed over the adjoining background of four squares within the same zone extending longitudinally two squares in length and disposed transversely two squares away from another wall in the same zone and disposed transversely one square away from another wall in an adjacent zone;

the fifth zone comprising a pair of rows including a plurality of squares having a third color foreground, and three walls disposed over the adjoining background of four squares within the same zone extending longitudinally two squares in length and disposed transversely two squares away from another wall in the same zone and disposed transversely one square away from another wall in an adjacent zone;

the sixth zone comprising a pair of rows including a plurality of squares having a fourth color foreground, and three walls disposed over the adjoining background of four squares within the same zone extending longitudinally two squares in length and disposed transversely two squares away from another wall in the same zone and disposed transversely one square away from another wall in an adjacent zone;

still another region being an East region, the East region having a first color, the East region comprising a seventh zone and an eighth zone, the seventh zone comprising a pair of rows including a plurality of squares having a fourth color foreground, and two walls disposed over the adjoining background of four squares within the same zone extending longitudinally two squares in length and disposed transversely two squares away from another wall in the same zone and disposed transversely one square away from another wall in an adjacent zone;

the eighth zone comprising a pair of rows including a plurality of squares having a third color foreground, and one wall disposed over the adjoining background of four squares within the same zone extending longitudinally two squares in length and disposed transversely one square away from another wall in an adjacent zone;

assigning a value to each of the game pieces such that each game piece may have a different value on a different colored foreground and background of the landing square for the game piece move;

initially positioning movable game pieces belonging to the first player on any of the squares of the three most Westerly rows and the second player on any of the squares of three most Easterly rows;

moving selected game pieces, within a player's turn, relative from the game piece move starting position, selected distances along the game board in one of the longitudinal direction, the transversal direction, and both the longitudinal direction and the transversal direction but never in a backwards direction, the maximum selected distance traveled forward per turn being any square in the adjacent zone relative to the game piece move starting position, the maximum selected distance traveled transversally per turn being limited by one of the portions of the regions, without squares and a wall;

in order to attain the victory condition, the victory condition being the first game piece to move off the the opponent's end of the game board.

4. The method of claim 3 wherein the step of positioning movable game pieces comprises:

initially positioning twenty-one movable game pieces of one color belonging to the first player on the squares of the three most Westerly rows and twenty-one movable game pieces of another color belonging to the second player on the squares of three most Easterly rows;

and wherein each of the game pieces having a face, the face having a code disposed upon the face, the code comprising a field and a symbol, the field having one of a third color, fourth color, second color and first color, the symbol being one of underbar, vertical bar, double vertical bar, triangle, and square and having one of a third color, fourth color, second color and first color.

* * * * *